United States Patent [19]

Levin

[11] Patent Number: 4,815,623

[45] Date of Patent: Mar. 28, 1989

[54] BEAN-BAG SUPPORTED LAP TRAY

[75] Inventor: Julian Levin, Johannesburg, South Africa

[73] Assignee: Factshore Limited, a British Company, United Kingdom

[21] Appl. No.: 104,378

[22] Filed: Oct. 5, 1987

[51] Int. Cl.[4] ..... B65D 25/20

[52] U.S. Cl. ..... 220/17.1; 220/22

[58] Field of Search ..... 220/17.1, 20, 22

[56] References Cited

U.S. PATENT DOCUMENTS 2,219,974 10/1940 Bellow .

4,052,944 10/1977 Jennings .

*Primary Examiner*—Joseph Man-Fu Moy

*Attorney, Agent, or Firm*—Stevens, Davis, Miller & Mosher

[57] ABSTRACT

A bean-bag supported lap tray of the type having a bean-bag containing a multitude of separate elements in a flexible bag arrangement carried on the underside of a lap tray is provided. The elements may be contained within flexible sheaths into which they are prepacked and may also be substantially confined to two different zones within the bag assembly. A preferred arrangement is one in which prepacked sheaths containing elements are adhesively secured to the underside of a tray and a flexible cover is secured over such sheaths.

11 Claims, 2 Drawing Sheets

BEAN-BAG SUPPORTED LAP TRAY

FIELD OF THE INVENTION

This invention relates to bean-bag supported lap trays by which term is meant a lap tray having secured to its undersurface a flexible cover housing therein a multitude of separate elements in the form of beans, beads, granules or the like which will collectively be termed "bean-bag elements", or simply "elements" in this specification. In use the elements form a ballast for supporting the lap tray.

BACKGROUND TO THE INVENTION

It is well known that a bean-bag secured to the underside of a lap tray, greatly assists in supporting the lap tray on the lap of a seated person in a stable and comfortable manner. This enables operations such as eating or the carrying out of any handiwork on the tray to be effected more easily and reliably than in the case of a lap tray not supported by means of a bean-bag.

In order to ensure that a bean-bag is properly supported on a person's lap it must be of an adequate size and the layer of elements located within the bean-bag must be sufficiently thick to ensure that a layer of elements is present at all required locations over the surface of the tray irrespective of the manner in which the elements may migrate towards one side of the bag in use. A cost factor is thus present in the quantity of elements required for the bag.

Furthermore, in the manufacture of such bean-bags, it is generally a messy operation to fill the prefabricated fabric bean-bags with certain types of elements such as, for example, expanded polystyrene beads. The reason for this is that, generally speaking, the bags for such bean-bag trays are made by a cut, make and trim operation (CMT) and this is conveniently carried out as a home industry by numerous different persons at different locations. In view of the fact that such bags are often required to be stitched closed, the filling thereof with the elements is conveniently carried out at the place where the bag is made.

It is one object of this invention to provide a bean-bag supported lap tray in which the quantity of elements employed in the bean-bag may be decreased without adversely affecting the performance of the lap tray assembly.

It is another object of the invention to provide a bean-bag supported lap tray which, in addition, or in the alternative, can be more easily or conveniently manufactured, particularly, but not exclusively, on a home industries type of basis.

It is yet another alternative object of this invention to avoid entirely the necessity of a sewing or stitching operation in the manufacture of such lap trays.

SUMMARY OF THE INVENTION

In accordance with one aspect of the invention there is provided a bean-bag supported lap tray in which the elements forming the content of the bean-bag are located within a flexible sheath into which such elements are prepacked and said prepacked sheath is housed in an outer cover which is attached to the underside of the lap tray.

Further features of this aspect of the invention provide for the sheath to be made of a flexible plastics film, preferably blown to a tubular shape and closed simply by heat sealing the two ends of a predetermined length thereof; for the plastics material to be a polyethylene or other suitable polymeric material; and, in the case where the material of which the sheath is made is impervious to air, for holes to be formed through the sheath to provide for the passage of air therethrough.

In accordance with a second aspect of this invention there is provided a bean-bag supported lap tray in which the elements defining the content of the bean-bag are located within at least one outer cover attached to the underside of the lap tray and are confined, by means of confining walls of flexible material, to at least two elongate zones extending in the same general transverse direction and either across the tray and located one on each side of the transverse centre-line of the tray or at each side of the tray with one on each side of the centre-line at right angles to said transverse centre-line.

Further features of this second aspect of the invention provide for the elements defining the content of the bean-bag to be contained within one or more sheaths in which they are prepacked; for such a sheath to have, extending along approximately a transverse centre-line thereof, a zone in which the upper and lower walls are secured to each other to define two substantially separate, laterally adjacent, parallel zones for containing the elements; and in the alternative, for two or more entirely separate prepacked sets of elements in sheaths to be located in one or two outer covers attached to the underside of the lap tray.

In either of the above aspects of the invention it is preferred that the outer cover and/or the sheath containing the bean-bag elements be adhesively secured to the underside of the lap tray in a substantially permanent manner although other forms of attachment are possible within the scope of this invention. It is envisaged that the adhesive securing of the outer cover or sheath to the underside of the lap tray will enable the lap tray assembly to be more appropriately adapted to the cottage industry type of operation up to its final assembly in which the bean-bag is adhesively attached to the tray.

In one form of the invention, stitching of the outer cover can be avoided entirely by adhesively securing the peripheral edge of a piece of fabric or the like to the underside of the tray which carries one or more sheaths of bean-bag elements adhesively secured thereto. Preferably, in such a case, the edge is caulked into a channel in the underside of the tray with a caulking strip and adhesive.

In order that the invention and its various aspects may be more fully understood, three different embodiments thereof will now be described.

DETAILED DESCRIPTION WITH REFERENCE TO THE DRAWINGS

Figure 1:
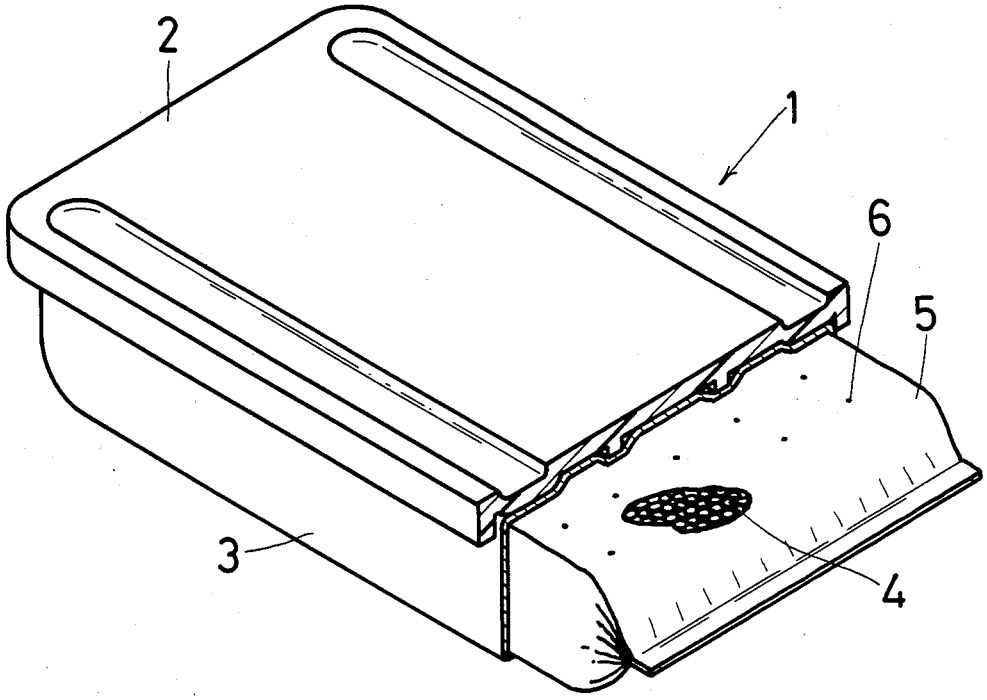
FIGS. 1, 2 & 3 are each partly broken away isometric views of three aspects of the invention; and, FIG. 4 is an enlarged cross-section through an edge region of the embodiment illustrated in FIG. 3.

In the embodiment of the invention illustrated in FIG. 1, a bean-bag supported lap tray, generally indicated by numeral 1, comprises an injection moulded plastics tray 2 to the underside of which is adhesively secured a flexible cloth outer cover 3.

The flexible outer cover receives therein the elements 4 defining the interior of the bean-bag such elements being contained within a flexible plastics sheath 5. Conveniently the sheath is made of thin, blown polyethylene sheet material which can be manufactured to the required diameter of tubular shape and simply sealed at two ends of a predetermined length thereof with the elements inside.

Clearly a prefabricated blown polyethylene sheet will be impervious and, accordingly, it will generally be necessary to form some perforations 6 therein in order to enable air to escape from the sheath and the ballast formed by the elements to perform its proper function without the air in the sheath partly or wholly supporting the load being carried by the lap tray.

It will be understood that, in order to manufacture bean-bag supported lap trays as above described, the sheaths with the elements therein can be prefabricated at a central factory and distributed to various different sites at which the outer covers can be manufactured by a cut, make and trim procedure. The filled sheaths lend themselves also to storage and use at a central factory, as may be required.

It will also be understood that, by providing a prefabricated sheath containing the bean bag elements therein, the outer cover can be stitched closed at any required site, for example in the carrying out of a cottage industry, and the outer cover may in fact be adhesively secured to the underside of a tray at the same place, if required.

In this manner a simple bean-bag supported lap tray is provided which can be most easily manufactured and wherein appropriate components can be conveniently manufactured at various different sites.

The filling of the bean-bags can be of any suitable material providing a multitude of independant elements and could, in fact, be beans, beads, granules or the like. Most conveniently there is employed substantially spherical expanded polystyrene or other foamed plastics beads or granules.

It will be appreciated that the cost of the elements defining the interior of the bean bag will be a significant proportion of the total cost of the bean-bag supported lap tray.

Figure 2:
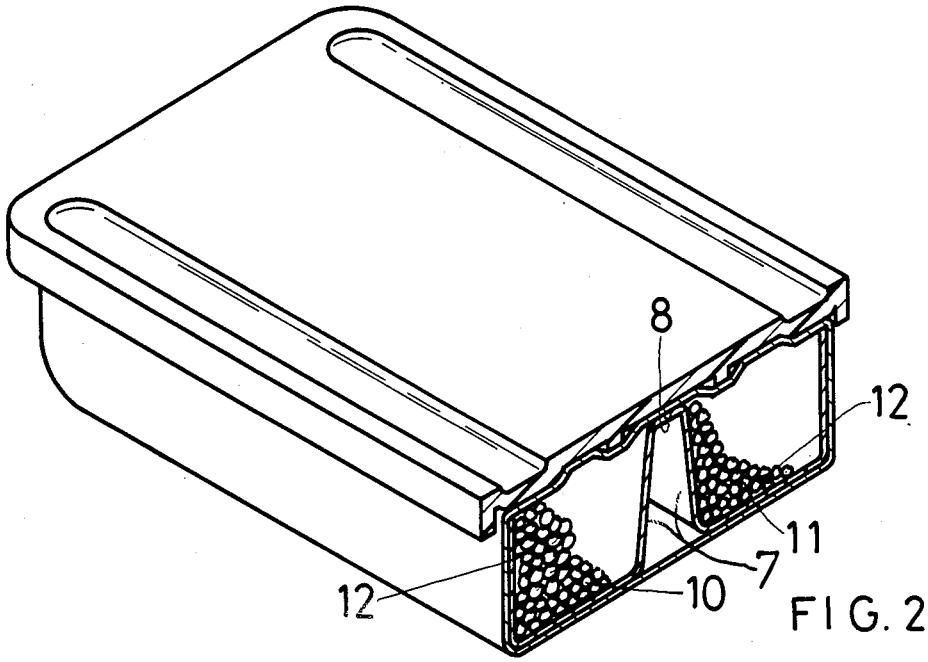

Accordingly where it is required to decrease the quantity of elements employed in a single bean-bag, whilst retaining the beneficial features thereof, the embodiment illustrated in FIG. 2 may conveniently be employed. In this case the sheath 7 has its sidewalls welded to each other down a central line as indicated by numeral 8. This divides the sheath into two elongate zones 10 and 11 in which the bean-bag elements 12 are located.

With this type of construction, as the bean-bag elements are restricted in transverse movement by the central weld, a lesser thickness of bean-bag elements will be required in order to achieve a satisfactory thickness of ballast for practical use in supporting a lap tray on a person's lap. This will greatly reduce the quantity of bean-bag elements to be employed in each unit.

It will be understood that, where the bean-bag elements are confined as described with reference to FIG. 2 of the drawings, it is not necessary that the first mentioned feature, namely the prefabricated sheath arrangement, be employed. Indeed the bean-bag elements could be located directly in an outer cover secured to the underside of the lap tray. It is also within the scope of the second aspect of this invention to provide two separate elongate bean-bags extending in the same general direction (that is transverse to a person's legs in the operative position) and spaced apart on each side of the transverse centre-line of the lap tray. This will achieve the same objective of requiring a lesser quantity of bean-bag elements and will, it is envisaged, provide as good, if not better, support to a lap tray in use.

Figure 3:
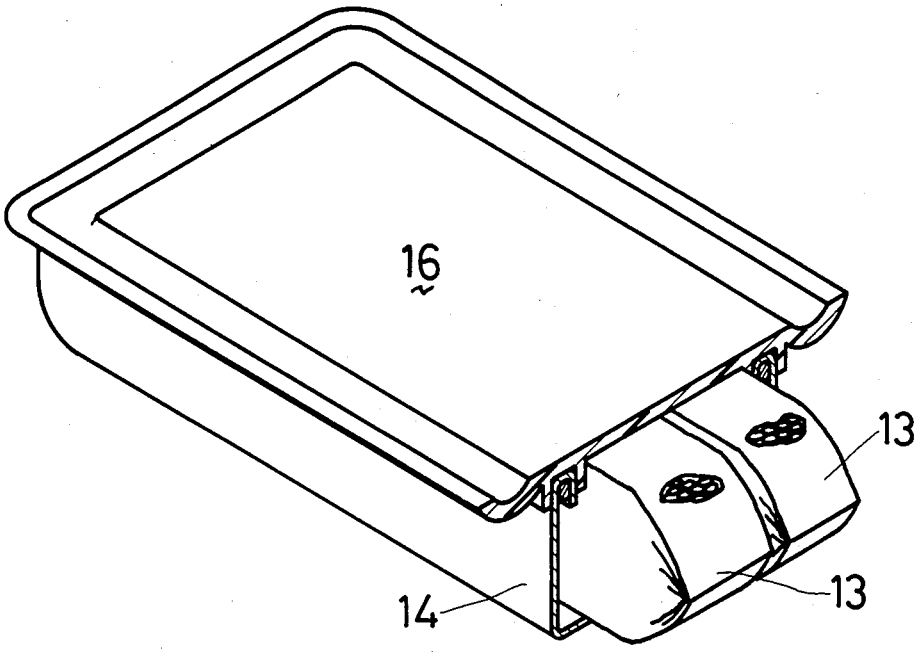

A further alternative, as illustrated in FIG. 3, is to provide two separate elongate prefabricated sheaths 13 containing bean-bag elements and enclosed within a single outer cover 14.

In this case the outer cover assumes the form of a simple cut sheet of fabric having its periphery 15 secured to the underside of the tray 16. This is most conveniently achieved by means of a caulking channel or groove 17 formed integrally with the undersurface of the tray and into which the periphery is adhesively secured with the aid of a caulking strip 18. This arrangement is shown most clearly in FIG. 4.

Also, in order to locate the sheaths properly within such a cover they are adhesively secured to the underside of the tray in their operative positions.

It will be appreciated that this invention provides improvements over the prior art bean-bag supported lap trays and that many variations are possible within the scope of this invention.

Figure 4:
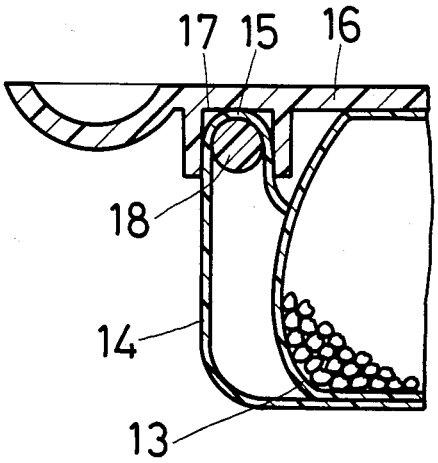

In particular, the simple cover arrangement described with reference to FIGS. 3 and 4 could be employed in respect of sheaths described with reference to FIGS. 1 or 2, the sheaths, in such a case, being adhesively secured to the underside of the tray.

Also, the caulking strip and groove described with reference to FIGS. 3 and 4 could be employed in the event that they are suitably shaped and of suitable material. A caulking groove and strip could also be used, with or without adhesive, to secure a peripheral flap of a complete bean-bag to the undersurface of a tray.

What I claim as new and desire to secure by Letters Patent is:

1. A lap tray having an operatively upper surface and an underside, a bean-bag associated with the underside of the tray, the bean-bag comprising a flexible bag arrangement containing a body of freely moveable elements therein adapted to cause the bag to operatively nestle on a person's lap to stably support the lap tray, the flexible bag arrangement including confining walls of flexible material defining at least two substantially separate, elongate zones for receiving the elements, said zones extending in the same general direction with one being located on each side of a center-line of the tray.

2. A lap tray as claimed in claim 1 in which said elements are located within one or more prepacked, closed flexible sheaths which are adhesively secured to the underside of the tray, the sheaths being covered by an outer cover attached to the underside of the lap tray.

3. A lap tray as claimed in claim 1 in which the said zones extend in a direction across the operatively lateral width of the tray.

4. A lap tray as claimed in claim 1 in which the elements are located within at least one flexible sheath adhesively secured to the underside of the tray and covered with an outer cover attached to the underside of the lap tray.

5. A lap tray as claimed in claim 4 in which the zones are defined by two separate sheaths each adhesively secured to the underside of the lap tray.

6. A lap tray as claimed in claim 4 in which a single sheath has extending along approximately a center-line thereof, a zone in which the upper and lower walls of the sheath are secured together to define two substantially separate, laterally adjacent zones for containing the elements.

7. A lap tray as claimed in claim 4 in which the sheath or sheaths are made of impervious flexible plastics film perforated to render same air pervious, the perforations having a substantially smaller in size than the size of the elements.

8. A lap tray as claimed in claim 2 in which the outer cover has a peripheral edge adhesively secured to the underside of the tray.

9. A lap tray as claimed in claim 2 in which the outer cover has a peripheral edge caulked onto a caulking groove on the underside of the tray by a caulking strip.

10. A lap tray as claimed in claim 4 in which the outer cover has a peripheral edge caulked into a caulking groove on the underside of the tray by a caulking strip.

11. A lap tray as claimed in claim 10 in which said peripheral edge is additionally adhesively secured to the underside of the tray.

* * * * *